US005100754A

United States Patent [19]

Yoerger et al.

[11] Patent Number: 5,100,754

[45] Date of Patent: Mar. 31, 1992

[54] COATED CARRIER PARTICLES AND ELECTROGRAPHIC DEVELOPERS CONTAINING THEM

[75] Inventors: William E. Yoerger; Frank A. Pettrone, both of Rochester, N.Y.

[73] Assignee: Eastman Kodak Company, Rochester, N.Y.

[21] Appl. No.: 449,684

[22] Filed: Dec. 12, 1989

[51] Int. Cl.[5] ..... G03G 9/00; G03G 5/00

[52] U.S. Cl. ..... 430/108; 430/904; 430/137

[58] Field of Search ..... 430/108, 137, 904

[56] References Cited

U.S. PATENT DOCUMENTS 3,922,382 11/1975 Kukla et al. ..... 430/108
3,970,571 7/1976 Olson et al. .
4,076,857 2/1978 Kasper et al. .
4,209,550 6/1980 Hagenbach et al. .
4,297,427 10/1981 Williams et al. .
4,434,220 2/1984 Abbott et al. ..... 430/108
4,478,925 10/1984 Miskinis .
4,546,060 10/1985 Miskinis et al. .
4,590,140 4/1986 Mitsuhashi et al. .
4,601,968 7/1986 Hyosu ..... 430/137
4,614,700 9/1986 Yamamoto et al. .
4,652,511 3/1987 Ueda et al. ..... 430/137
4,822,708 4/1989 Machida et al. ..... 430/108
4,845,006 7/1989 Matsubara et al. ..... 430/99
4,855,206 8/1989 Saha ..... 430/108 X
4,929,528 5/1990 Shinoki et al. ..... 430/108

*Primary Examiner*—Marion E. McCamish
*Assistant Examiner*—Stephen C. Crossan
*Attorney, Agent, or Firm*—David F. Janci

[57] ABSTRACT

The invention provides coated carrier particles and dry electrographic developers comprising a mixture of the carrier particles and toner particles. Each of the carrier particles comprises a core particle having a polymeric overcoat comprising a blend of a fluorine-containing polymer and a modifying polymer comprising poly(p-t-butylstyrene) or a copolymer of p-t-butylstyrene and a $C_1$–$C_4$ alkyl methacrylate.

7 Claims, No Drawings

COATED CARRIER PARTICLES AND ELECTROGRAPHIC DEVELOPERS CONTAINING THEM

FIELD OF THE INVENTION

This invention relates to coated carrier particles and to dry electrographic developers comprising a mix of such carrier particles and toner particles. More particularly, the invention concerns certain polymeric coatings on carrier particles that unexpectedly impart certain desirable characteristics to the carrier particles.

BACKGROUND

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer. If desired, the latent image can be transferred to another surface before development.

One well-known type of electrographic developer comprises a dry mixture of toner particles and carrier particles. Developers of this type are commonly employed in well-known electrographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the electrostatic latent image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited in the desired amount on the latent image-bearing surface. In order to meet these requirements for proper development, the level of electrostatic charge on the toner and carrier particles should be maintained within an adequate range.

Toner particles in dry developers often contain material referred to as a charge agent or charge-control agent, which helps to establish and maintain toner charge within an acceptable range. Many types of charge-control agents have been used and are described in the published patent literature. However, the level of charge that will be created and maintained on the toner is still very dependent on the nature and condition of the carrier particles.

Many known dry, two-component electrostatographic developers contain thermoplastic toner particles and carrier particles that comprise a core material coated with a fluorine-containing polymer, such as poly(vinylidene fluoride) or poly(vinylidene fluoride-co-tetrafluoroethylene). See, for example, U.S. Pat. Nos. 4,614,700; 4,546,060; 4,478,925; 4,076,857; and 3,970,571.

Such fluoropolymer carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

However, while such carrier coatings can serve all of the above-noted purposes well, in some cases they do not adequately serve some or all of those purposes simultaneously. For example, in some developer compositions, fluoropolymer carrier coatings can serve many of the above-noted purposes well, but, depending upon the nature of the toner particles and carrier core material desired to be included in the developer, such carrier coatings can cause the developer to acquire a triboelectric charge that is too high for optimum developer performance; i.e., the electrostatic latent image has difficulty pulling the toner particles away from the carrier particles. This is especially true in some positively charged developers (developers in which the toner particles triboelectrically acquire a positive charge, and the coated carrier particles acquire a negative charge).

Some prior patent publications describe means for alleviating this problem to some degree by blending the fluoropolymer with another modifying polymer having triboelectric characteristics different from the fluoropolymer and coating the blend on carrier core particles in order to further alter the carrier particles' triboelectric charging characteristics and, in some cases, provide other desirable properties, such as better adhesion of the coating to the core particles. Many different types of polymers have been described as useful for this purpose, among which are, for example, various styrene and methacrylate polymers and copolymers thereof. For example, U.S. Pat. Nos. 4,209,550; 4,297,427; and 4,590,140, suggest that, among many other polymers, poly(styrene), poly(methyl methacrylate), and poly(styrene-co-methyl methacrylate) may serve this purpose.

However, we have found that most of such polymeric materials exhibit one or more drawbacks when it is attempted to blend them with fluoropolymers and coat the blend on carrier core particles for this purpose.

For example, some of the suggested polymeric materials are not triboelectrically potent enough or different enough from the fluoropolymers to achieve the desired alteration in charging tendency of the carrier particles in certain developers. Also, the less triboelectrically efficient or potent the additional modifying polymer is for this purpose, the less of the fluoropolymer can remain in the blend in order to exhibit the desirable characteristics of fluoropolymer coatings noted above. For example, in the case where carrier core particles comprise stontium ferrite materials and have average particle diameters in the range of about 30 to 40 micrometers, it is desirable to be able to retain as much of the fluoropolymer in the coating as possible, and preferably at least about 1 part (by weight) of the fluoropolymer per 100 parts of carrier core material. However, one of the most desirable means of forming the coating on the core particles (often referred to as melt-coating) is to mix the core particles with finer particles of the coating material in solid form to distribute the coating particles over the core particles' surfaces, apply heat to cause the material to flow just enough to coat the core surfaces, allow the mix to cool, and then break apart the solidified mass to yield the discrete coated carrier particles. If the concentration of coating blend exceeds 3 parts per hundred parts (pph) of core material in the specific case noted above, the solidified mass becomes exceedingly difficult to properly break apart. Thus, since it is desirable in that case to include at least 1 pph of the fluoropolymer and undesirable to include more than 3 pph of total coating blend, the amount of modifying polymer that can be added is limited (it should be noted that the specific preferable minimum and maximum concentrations of coating material recited above will be different for different core particles that may have different average particle sizes, different core material densities, and/or different surface area-to-mass ratios). The more efficient the modifying polymer is at desirably altering the carrier particles' charging characteristics, the more desirable it is, in terms of achieving the desired charging characteristics and maximizing the amount of fluoropolymer within the practical upper limits of total blended coating material.

Another drawback of some materials that might be obvious to try as modifying polymers in the blend is their lack of thermal stability, leading to degradation during melt-blending at temperatures needed to properly coat the fluoropolymer (e.g., about 210°-230° C. in the case of poly(vinylidene fluoride)) and degradation during use in electrographic development, with consequent inconsistent triboelectric properties initially and over time and shorter carrier life (because of more carrier chipping, flaking, dusting, and scumming).

A further drawback of some possible modifying polymers is that the temperature range in which they will flow just enough to properly coat the carrier cores in a melt-coating process does not match or overlap the proper temperature range for the desired fluoropolymer, with possible consequences such as incomplete or non-uniform coating, poor coating adhesion, inconsistent carrier performance, and shorter carrier life.

Yet another drawback of some possible modifying polymers is the unexplained tendency of carrier particles coated therewith to cause unacceptably high levels of dusting in electrographic development use. Dusting (also referred to as throw-off) is defined as the amount of toner and any other particulate matter that is thrown out of the developer (i.e., that is not adequately held to the surfaces of the carrier particles) during agitation of the developer, e.g., by a typical development apparatus such as a magnetic roll applicator. High levels of dusting can involve undesirable effects such as excessive wear and damage of electrostatographic imaging apparatus, contamination of toner with dirt or carrier material leading to higher charge variation, contamination of environmental air with toner powder and other particulate matter, unwanted development of background image areas, and scumming of the surface of photoconductive elements that leads to poorer electrophotographic performance and shorter useful life.

Thus, there remains a need for suitable modifying polymers to be blended with fluorine-containing polymers and coated on carrier core particles to adjust their triboelectric charging characteristics with respect to various types of toner particles in electrographic developers. Such modifying polymers should be highly potent or efficient when blended with appropriate fluoropolymers in relatively small amounts in order to adequately modify carrier charging characteristics while retaining desirable properties imparted by the fluoropolymers, should have good thermal stability, should have proper flow characteristics for melt-coating in a temperature range matching or overlapping the proper coating temperature range for the fluoropolymers with which it is desired to blend them, and should not cause carrier particles to exhibit high dusting characteristics in electrographic developers. The present invention meets that need.

SUMMARY OF THE INVENTION

The invention provides new coated carrier particles and dry electrographic developers.

Each of the carrier particles of the invention comprises a core particle having a polymeric overcoat comprising a blend of a fluorine-containing polymer and a modifying polymer comprising poly(p-t-butylstyrene) or a copolymer of p-t-butylstyrene and a $C_1$-$C_4$ alkyl methacrylate.

Dry electrographic developers of the invention comprise a mixture of positively charged toner particles and the inventive carrier particles defined above, bearing negative charges.

The modifying polymers defined above as useful in accordance with the invention are very efficient at modifying carrier triboelectric charging characteristics when blended in minor proportions with fluorine-containing polymers of choice. The modifying polymers have good thermal stability and exhibit proper melt-coating flow characteristics in a temperature range matching or overlapping the proper coating temperature range for the fluoropolymers it is desired to blend them with in accordance with the invention. In electrographic developers of the invention, the inventive coated carrier particles do not cause unacceptably high levels of dusting during developer use.

DESCRIPTION OF PREFERRED EMBODIMENTS

The present invention is beneficially applicable to carrier particles comprising any of the core materials generally known to be useful in carrier particles for electrographic developers. The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; 4,546,060; 4,764,445; 4,855,205; and 4,855,206.

The fluorine-containing polymer included in the blend of polymers coated on the carrier core particles comprises any of the fluoropolymers known to be useful in general as carrier coating materials. See, for example, U.S. Pat. Nos. 4,614,700; 4,546,060; 4,478,925; 4,076,857; and 3,970,571. Some specific examples of such fluoropolymers are poly(tetrafluoroethylene), poly(vinylidene fluoride), poly(hexafluoropropylene), and mixtures and copolymers thereof.

As described above, the modifying polymer included in the blend comprises poly(p-t-butylstyrene) or a copolymer of p-t-butylstyrene and a $C_1$–$C_4$ alkyl methacrylate (e.g., methyl methacrylate or isobutyl methacrylate). When one of the copolymers is chosen, the proportions of recurring units are not critical, but in some preferred embodiments weight proportions of 1 to 1 were employed.

It is optional but preferred that the modifying polymer further comprise sulfur-containing end groups, because such polymers exhibit even better thermal stability and even greater efficiency in altering the triboelectric charging characteristics imparted by the fluoropolymers than do the polymers without such end groups. When using well-known processes of preparing the modifying polymers, such as suspension polymerization or emulsion polymerization, it is a simple matter to create such end groups in a known manner, for example, by using a persulfate as the polymerization initiator and/or by including a mercaptan chain transfer agent in the polymerization process. When a mercaptan chain transfer agent is employed, it is preferable to include a relatively small amount of such agent (e.g., 1 percent or less, and more preferably about 0.25 percent, based on the total weight of monomers employed) so as not to create an inordinate amount of chain termination that would yield polymers of such low molecular weight that they would be too brittle to serve well as carrier coating materials and/or would have a flow temperature range for proper melt-coating that would be too low to match or overlap the temperature range adequate for proper melt-coating of the fluoropolymers with which they are intended to be blended.

As mentioned previously, the modifying polymers useful in the present invention have better thermal stability than polymers taught in the prior art to be used as modifying polymers on carriers. This can be illustrated by comparing the results of thermal gravimetric analysis tests on the various polymers, wherein the polymer is heated in air, the temperature of which is slowly increased from 75° to 800° C., and the temperature at which noticeable weight loss first occurs is noted. For example, the temperature at which initial noticeable weight loss occurs is 283° C. for poly(methyl methacrylate) and 281° C. for poly(styrene-co-methyl methacrylate) (50:50) (both polymers not useful within the scope of the invention), while the onset of weight loss occurs at 305° C. for poly(p-t-butylstyrene), 303° C. for poly(p-t-butylstyrene-co-methyl methacrylate) (50:50), and 306° C. for a poly(p-t-butylstyrene-co-methyl methacrylate) (50:50) having sulfur-containing end groups (all three of these polymers being useful within the scope of the invention).

Methods of coating a blend of fluoropolymer and modifying polymer onto carrier core particles in a continuous or discontinuous configuration of various uniform or non-uniform thickness are well known. Some useful coating methods include solvent coating, spray application, plating, tumbling, shaking, fluidized bed coating, and melt-coating. Any such methods can be employed to prepare the coated carrier particles of this invention, but known melt-coating methods are preferred, wherein the carrier core particles are mixed with a blend of finer particles of the fluoropolymer and modifying polymer, enough heat is applied to cause the polymeric material to flow just enough to coat the core surfaces, the mix is cooled to fix the coating on the core, and the solidified mixture is broken apart to yield the discrete coated carrier particles. See, for example, U.S. Pat. Nos. 4,546,060; 4,478,925; 4,233,387; and 4,209,550.

In coating blends useful for the present invention, relative proportions of the fluoropolymer and modifying polymer can be varied to achieve the desired properties. Optimum proportions will depend on the nature of all materials involved (including the nature of toner particles with which the carrier particles are intended to be subsequently mixed in order to form a developer of the invention) and the amount of charge per unit mass desired, but in most cases the fluoropolymer will comprise the major portion of the blend, and the modifying polymer will comprise the minor portion, as mentioned previously.

Also, as mentioned previously, in the specific case of strontium ferrite core particles having average particle diameters in the range of about 30 to 40 micrometers, the coating will usually comprise, by weight, 3 pph coating material (parts per hundred parts core material) or less, especially if melt-coating is employed, because higher proportions of coating material may make it very difficult to properly break apart the solidified mass to yield the discrete coated carrier particles. Note again that this preferable upper limit of weight ratio of coating material to core material will vary as surface area-to-mass ratio of the core particles varies; i.e., the preferable upper limit will be higher when surface area-to-mass is higher than in the specific case noted and will be lower when surface area-to-mass is lower than in the specific case noted.

The resultant carrier particles can be spherical or irregular in shape, can have smooth or rough surfaces, and can be of any size known to be useful in developers.

Conventional carrier particles usually have an average particle diameter in the range of about 2 to about 1200 micrometers, preferably 2–300 micrometers.

In some preferred embodiments of the invention strontium ferrite core particles having an average diameter of about 30 micrometers (μm) were mixed with about 0.3 μm poly(vinylidene fluoride) particles and 1–3 μm particles of modifying polymer [comprising poly(p-t-butylstyrene), poly(p-t-butylstyrene-co-methyl methacrylate) (50:50 recurring unit weight ratio), or poly(p-t-butylstyrene-co-isobutyl methacrylate) (50:50 weight ratio), with and without sulfur-containing end groups]. The weight proportions of core particles:fluoropolymer particles:modifying polymer particles were in the range of 100:2:0.0625–1.0. The mix was agitated and then maintained at about 210°–230° C. for 2–4 hours, allowed to cool to room temperature, and broken apart to yield the discrete coated carrier particles.

In forming electrographic developers of the invention, the inventive carrier particles are mixed with any suitable toner particles known to be useful in dry electrographic developers. Carriers of the present invention are especially advantageous in developers wherein the toner particles triboelectrically acquire a positive charge during mixing while the carrier particles acquire a negative charge.

Useful toner particles comprise at least a binder resin and, optionally, other addenda such as colorants, charge-control agents, release agents, etc., as is well known.

Many resins have been reported in the published literature as being useful as dry toner binders. These include vinyl polymers, such as homopolymers and copolymers of styrene and condensation polymers such as polyesters and copolyesters. Especially useful binder resins for toners useful in developers of the present invention are styrenic polymers of from 40 to 100 percent by weight of styrene or styrene homologs and from 0 to 45 percent by weight of one or more lower alkyl acrylates or methacrylates. Preferred are fusible styrene-acrylic copolymers which are covalently lightly crosslinked with a divinyl compound such as divinylbenzene as disclosed in the patent to Jadwin et al, U.S. Pat. No. Re. 31,072. Also especially useful are polyesters of aromatic dicarboxylic acids with one or more aliphatic diols, such as polyesters of isophthalic or terephthalic acid with diols such as ethylene glycol, cyclohexane dimethanol and biphenols. Examples are disclosed in the patent to Jadwin et al, above.

Useful binder resins have fusing temperatures in the range of about 50° C. to 200° C. so that the toner particles can readily be fused after development. Preferred are resins which fuse in the range of about 65° C. to 120° C. If toner transfer is made to receiving sheets which can withstand higher temperatures, polymers of higher fusing temperatures can be used.

A colorant for the toner can be selected from a wide variety of dyes and pigments such as those disclosed, for example, in U.S. Pat. No. Re. 31,072. A particularly useful colorant for toners to be used in black and white electrophotographic copying machines is carbon black. The amount of colorant in the toner can vary over a wide range, for instance, from 1 to 20 weight percent of the toner. For some uses, no colorant is added to the toner, but usually from about 1 to 6 weight percent of colorant is present.

Other addenda can include charge control agents, those usually being ionic compounds such as ammonium or phosphonium salts. Suitable charge control agents are disclosed, for example, in U.S. Pat. Nos. 3,893,935; 4,079,014; 4,323,634 and 4,840,864. Only a small concentration of charge control agent is normally used in the toner composition, e.g., from about 0.05 to 6 weight percent and preferably from 0.05 to 2.0 weight percent.

Useful toner particles range in diameter from 0.5 to 25 micrometers with an average size of 1 to 16 micrometers. Preferably, the average particle size ratio of carrier to toner is within the range of about 15:1 to about 1:1. However, carrier-to-toner average particle size ratios of as high as 50:1 are also useful.

Within developers of the invention, high concentrations of toner can be employed. Accordingly, the present developer preferably contains from about 70 to 99 weight percent carrier and from about 30 to 1 weight percent toner based on the total weight of the developer; most preferably, such concentration is from about 80 to 99 weight percent carrier and from about 20 to 1 weight percent toner.

Developer compositions of this invention can be used in various known ways to develop electrostatic charge patterns or latent images. Such developable charge patterns can be prepared by a number of means and be carried, for example, on a light-sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a developer formed into a magnetic brush by a magnetic applicator apparatus. This latter technique involves the use of magnetically attractable carrier particles in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of paper and then fused to form a permanent image.

The following examples are presented to further illustrate some preferred embodiments of carriers and developers of the invention and to compare their properties to those of carriers and developers outside the scope of the invention.

In all of the following examples and controls the carrier particles comprised strontium ferrite carrier cores melt-coated with a blend of poly(vinylidene fluoride) and various modifying polymers. They were prepared by using a formulation comprising 2 parts by weight poly(vinylidene fluoride) particles, various parts by weight of particles of various modifying polymers, and 100 parts by weight strontium ferrite particles. Two kilograms of the formulation were placed in a 4-liter wide-mouth glass jar and capped. The jar was vigorously shaken by hand and then roll-milled for 45 minutes at 140 revolutions per minute. The cap was then removed, and the jar was placed in a convection oven set at a temperature of 210° C. for 2 hours. After being allowed to cool to room temperature, the coated particles were passed through a sieve having 62-micrometer openings to break up any large agglomerates.

In the Examples the triboelectric properties of the carrier particles were indirectly determined by measuring the degree of charge imparted to toner particles with which they were mixed. The degree of charge was determined by mixing the carrier particles with typical toner particles (comprising a quaternary phosphonium salt charge agent and a magenta colorant, dispersed in a branched amorphous polyester binder) to form a charged electrographic developer comprising 13% toner particles by weight and measuring the level of charge residing on the toner particles, in microcoulombs per gram of toner (μc/g), after 5 minutes of continuous exercise of the developer. The continuous exercise of the developer involved placing the magnetized developer in a glass bottle held in place on top of a typical device designed to form a developer into an agitating magnetic brush for development of electrostatic images into toner images (in this case a cylindrical roll with rotating magnetic core). Thus, the continuous exercising closely approximated typical actual use of the developer in an electrographic development process.

Since the purpose in measuring toner charge level in the examples was merely to illustrate the degree of charge of developers containing inventive carrier particles relative to the degree of charge of similar developers containing carriers not in accordance with the invention, any known convenient method for measuring toner charge levels could be used. In the examples below, toner charge level was measured by placing a 0.05 to 0.1 g portion of the charged developer in a sample dish situated between electrode plates and subjecting it, simultaneously for 30 seconds, to a 60 Hz magnetic field to cause developer agitation and to an electric field of about 2000 volts/cm between the plates. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner in microcoulombs per gram (μc/g).

In some of the examples the degree of dusting (throw-off) was determined by: mixing the carrier particles with the same typical toner particles as described above to form a charged developer comprising 12% toner by weight; agitating the developer for about 10 minutes; mixing more of the same type of toner particles into the developer to form a charged developer comprising 18% toner by weight; placing the developer in an open container held in place on top of a typical device designed to form a developer into an agitating magnetic brush for development of electrostatic latent images into toner images (in this case a cylindrical roll with rotating magnetic core); placing a funnel, containing a weighed piece of fiberglass filter paper and a vacuum hose connected to its spout, in an inverted position securely over the open container; simultaneously for one minute, rotating the magnetic core to form an agitating magnetic developer brush as in a normal development process and applying vacuum to the funnel to collect on the filter paper any material thrown off of the agitating magnetic developer brush; weighing the filter paper and collected material; and then subtracting the weight of the filter paper alone from this combined weight to determine the degree of dusting in milligrams (mg).

In the examples and controls, whenever a copolymer formed from two different monomers was employed, the weight ratio of the two different types of recurring units was 50:50. Where the notation, "persulfate", appears after the name of a polymer, this is intended to mean that the polymer includes sulfur-containing end groups, formed by using a persulfate polymerization initiator in preparing the polymer. Where the notation, "0.25 TDDM", appears after the name of a polymer, this is intended to mean that the polymer includes sulfur-containing end groups formed by preparing the polymer by polymerization in the presence of 0.25 parts by weight of the chain transfer agent, t-dodecylmercaptan, per 100 parts by weight of the total monomers present during the polymerization. As noted previously, all coatings in the examples and controls contained the indicated parts by weight (pph) of modifying polymer and 2 parts by weight of poly(vinylidene fluoride), per 100 parts by weight of carrier core material.

EXAMPLES 1-29

In examples 1-29, the effect on toner charge of including various types and amounts of modifying polymers blended with poly(vinylidene fluoride) in carrier coatings in accordance with the invention, is illustrated and compared to control examples containing either no modifying polymer or various types and amounts of modifying polymers, not in accordance with the invention, blended with poly(vinylidene fluoride) in the carrier coatings. Results are presented in Table I.

TABLE I

| Example | Modifying Polymer | pph | toner charge (μc/g) |
|---|---|---|---|
| Control A | none | 0 | 37.5 |
| Control B | poly(methyl methacrylate) | 1.0 | 24.0 |
| 1 | poly(p-t-butylstyrene) | 0.25 | 19.0 |
| 2 | " | 0.50 | 12.8 |
| 3 | " | 0.75 | 10.2 |
| 4 | " | 1.0 | 7.2 |
| Control C | poly(vinyltoluene-co-methyl methacrylate) | 0.25 | 27.2 |
| Control D | poly(vinyltoluene-co-methyl methacrylate) | 0.50 | 22.0 |
| Control E | poly(vinyltoluene-co-methyl methacrylate) | 0.75 | 20.2 |
| Control F | poly(vinyltoluene-co-methyl methacrylate) | 1.0 | 18.0 |
| Control G | poly(styrene-co-methyl methacrylate) | 0.50 | 22.7 |
| Control H | poly(styrene-co-methyl methacrylate) | 1.0 | 18.2 |
| 5 | poly(p-t-butylstyrene-co-methyl methacrylate) | 0.25 | 28.0 |
| 6 | poly(p-t-butylstyrene-co-methyl methacrylate) | 0.38 | 24.1 |
| 7 | poly(p-t-butylstyrene-co-methyl methacrylate) | 0.50 | 22.0 |
| 8 | poly(p-t-butylstyrene-co-methyl methacrylate) | 0.75 | 18.0 |
| 9 | poly(p-t-butylstyrene-co-methyl methacrylate) | 1.0 | 14.7 |
| 10 | poly(p-t-butylstyrene-co-isobutyl methacrylate) | 0.19 | 21.1 |
| 11 | poly(p-t-butylstyrene-co-isobutyl methacrylate) | 0.25 | 19.5 |
| 12 | poly(p-t-butylstyrene-co-isobutyl methacrylate) | 0.38 | 16.1 |
| 13 | poly(p-t-butylstyrene-co-isobutyl methacrylate) | 0.50 | 12.9 |
| 14 | poly(p-t-butylstyrene-co-isobutyl methacrylate) | 0.75 | 9.9 |
| Control I | poly(vinyltoluene-co-methyl methacrylate) (0.25 TDDM) | 0.50 | 22.3 |
| Control J | poly(vinyltoluene-co-methyl methacrylate) (0.25 TDDM) | 0.75 | 19.0 |
| Control K | poly(vinyltoluene-co-methyl methacrylate) (0.25 TDDM) | 1.0 | 16.5 |
| 15 | poly(p-t-butylstyrene-co-methyl methacrylate) (0.25 TDDM) | 0.25 | 24.1 |

TABLE I-continued

| Example | Modifying Polymer | pph | toner charge (μc/g) |
|---|---|---|---|
| 16 | poly(p-t-butylstyrene-co-methyl methacrylate) (0.25 TDDM) | 0.38 | 20.8 |
| 17 | poly(p-t-butylstyrene-co-methyl methacrylate) (0.25 TDDM) | 0.50 | 17.4 |
| 18 | poly(p-t-butylstyrene-co-methyl methacrylate) (0.25 TDDM) | 0.75 | 13.5 |
| Control L | poly(vinyltoluene-co-isobutyl methacrylate) (0.25 TDDM) | 0.25 | 17.2 |
| Control M | poly(vinyltoluene-co-isobutyl methacrylate) (0.25 TDDM) | 0.38 | 13.2 |
| Control N | poly(vinyltoluene-co-isobutyl methacrylate) (0.25 TDDM) | 0.50 | 11.3 |
| Control O | poly(vinyltoluene-co-isobutyl methacrylate) (0.25 TDDM) | 0.75 | 9.0 |
| 19 | poly(p-t-butylstyrene-co-isobutyl methacrylate) (0.25 TDDM) | 0.13 | 22.2 |
| 20 | poly(p-t-butylstyrene-co-isobutyl methacrylate) (0.25 TDDM) | 0.19 | 19.2 |
| 21 | poly(p-t-butylstyrene-co-isobutyl methacrylate) (0.25 TDDM) | 0.25 | 14.6 |
| 22 | poly(p-t-butylstyrene-co-isobutyl methacrylate) (0.25 TDDM) | 0.38 | 9.0 |
| 23 | poly(p-t-butylstyrene-co-isobutyl methacrylate) (0.25 TDDM) | 0.50 | 5.2 |
| Control P | poly(vinyltoluene-co-methyl methacrylate) (persulfate) | 0.13 | 24.6 |
| Control Q | poly(vinyltoluene-co-methyl methacrylate) (persulfate) | 0.25 | 17.2 |
| Control R | poly(vinyltoluene-co-methyl methacrylate) (persulfate) | 0.38 | 13.8 |
| Control S | poly(vinyltoluene-co-methyl methacrylate) (persulfate) | 0.50 | 11.2 |
| Control T | poly(vinyltoluene-co-methyl methacrylate) (persulfate) | 0.75 | 10.0 |
| 24 | poly(p-t-butylstyrene-co-methyl methacrylate) (persulfate) | 0.06 | 22.0 |
| 25 | poly(p-t-butylstyrene-co-methyl methacrylate) (persulfate) | 0.13 | 17.2 |
| 26 | poly(p-t-butylstyrene-co-methyl methacrylate) (persulfate) | 0.19 | 13.5 |
| 27 | poly(p-t-butylstyrene-co-methyl methacrylate) (persulfate) | 0.25 | 12.2 |
| 28 | poly(p-t-butylstyrene-co-methyl methacrylate) (persulfate) | 0.38 | 11.7 |
| 29 | poly(p-t-butylstyrene-co-methyl methacrylate) (persulfate) | 0.50 | 8.7 |

The data in Table I demonstrate the generally better charge-modifying efficiency of modifying polymers in coated carriers in accordance with the invention. The data also show that increased proportions of modifying polymers had an increased charged-modifying effect and that modifying polymers having sulfur-containing end groups exhibited even better charge-modifying efficiency.

While vinyltoluene copolymers in the controls exhibited fairly good efficiency, such copolymers caused much higher levels of undesirable dusting than modifying polymers useful in accordance with the invention, as illustrated in the examples below.

EXAMPLES 30–31

In Examples 30–31, the effect on toner charge and developer dusting, of including various types and amounts of modifying polymers blended with poly(vinylidene fluoride) in carrier coatings in accordance with the invention, is illustrated and compared to control examples containing either no modifying polymer or various types and amounts of modifying polymers, not in accordance with the invention, blended with poly(vinylidene fluoride) in the carrier coatings. Results are presented in Table II.

TABLE II

| Example | Modifying Polymer | pph | toner charge (μc/g) | dusting (mg) |
|---|---|---|---|---|
| Control U | none | 0 | 35.8 | 0.4 |
| Control V | poly(vinyltoluene-co-isobutyl methacrylate) (0.25 TDDM) | 0.25 | 15.4 | 47.6 |
| 30 | poly(p-t-butylstyrene-co-isobutyl methacrylate) (0.25 TDDM) | 0.25 | 15.7 | 1.0 |
| Control W | poly(vinyltoluene-co-isobutyl methacrylate) (0.25 TDDM) | 0.75 | 16.2 | 20.5 |
| 31 | poly(p-t-butylstyrene-co-methyl methacrylate) (0.25 TDDM) | 0.50 | 18.2 | 4.2 |

The data in Table II demonstrate that coated carriers in accordance with the invention do not produce unacceptably high levels of dusting and that, while some coated carriers outside the scope of the invention yield adequate charge modification, they also cause unacceptably high levels of developer dusting.

The invention has been described in detail, with particular reference to certain preferred embodiments thereof, but it should be understood that variations and modifications can be effected within the spirit and scope of the invention.

What is claimed is:

1. Carrier particles suitable for use in a dry electrographic developer comprising a mix of the carrier particles and toner particles, wherein each of the carrier particles comprises a core particle having a polymeric overcoat comprising a blend of a fluorine-containing polymer and a modifying polymer comprising poly(p-t-butylstyrene) or a copolymer of p-t-butylstyrene and a $C_1$–$C_4$ alkyl methacrylate, wherein the modifying polymer further comprises sulfur-containing end groups as a result of having been polymerized in the presence of a persulfate or a mercaptan.

2. The carrier particles of claim 1, wherein the fluorine-containing polymer comprises poly(vinylidene fluoride).

3. The carrier particles of claim 1, wherein the modifying polymer comprises poly(p-t-butylstyrene), poly(p-t-butylstyrene-co-methyl methacrylate), or poly(p-t-butylstyrene-co-isobutyl methacrylate).

4. The carrier particles of claim 1, wherein the core particle comprises a metallic material.

5. The carrier particles of claim 4, wherein the metallic material is ferromagnetic.

6. The carrier particles of claim 4, wherein the metallic material comprises a strontium ferrite material.

7. A dry electrographic developer comprising a mixture of positively charged toner particles and negatively charged carrier particles comprising the carrier particles of claim 1.

* * * * *